US011306534B2

(12) United States Patent
Goldberg

(10) Patent No.: US 11,306,534 B2
(45) Date of Patent: Apr. 19, 2022

(54) CONNECTOR FOR A LOOPED OPERATING ELEMENT OF AN ARCHITECTURAL-STRUCTURE COVERING

(71) Applicant: Hunter Douglas Inc., Pearl River, NY (US)

(72) Inventor: Michael S. Goldberg, Stanley, NC (US)

(73) Assignee: Hunter Douglas Inc., Pearl River, NY (US)

( * ) Notice: Subject to any disclaimer, the term of this patent is extended or adjusted under 35 U.S.C. 154(b) by 107 days.

(21) Appl. No.: 16/747,884

(22) Filed: Jan. 21, 2020

(65) Prior Publication Data

US 2020/0248502 A1 Aug. 6, 2020

Related U.S. Application Data

(60) Provisional application No. 62/801,955, filed on Feb. 6, 2019.

(51) Int. Cl.
*E06B 9/326* (2006.01)
*E06B 9/322* (2006.01)
(Continued)

(52) U.S. Cl.
CPC ..... *E06B 9/326* (2013.01); *E06B 9/322* (2013.01); *E06B 9/324* (2013.01);
(Continued)

(58) Field of Classification Search
CPC ..... E06B 9/326; E06B 9/322; E06B 9/324; E06B 2009/785; E06B 2009/3265;
(Continued)

(56) References Cited

U.S. PATENT DOCUMENTS 1,575,161 A 3/1926 Grode
2,250,549 A 7/1941 Omer
(Continued)

FOREIGN PATENT DOCUMENTS

CN 104196961 A 12/2014
EP 2832252 B1 9/2016
(Continued)

*Primary Examiner* — Daniel P Cahn
*Assistant Examiner* — Matthew R. Shepherd
(74) *Attorney, Agent, or Firm* — Kacvinsky Daisak Bluni PLLC

(57) ABSTRACT

A connector for coupling to a bead chain is disclosed. In use, the connector is arranged and configured so that the connector can pass over a bearing. In one example of an embodiment, the bearing is positioned in a tensioner so that the connector moves through the tensioner, which is operatively coupled to the bead chain. In one example embodiment, application of a force on the bead chain to move the covering between an extended position and a retracted position, self-orients the connector so that a top portion of the connector faces and/or contacts the bearing so that the connector smoothly passes across an exterior arcuate surface of the bearing. In one example embodiment, the top portion includes a curved surface to contact the curved surface of the bearing.

14 Claims, 9 Drawing Sheets

(51) Int. Cl.
*E06B 9/324* (2006.01)
*E06B 9/78* (2006.01)
*E06B 9/262* (2006.01)

(52) U.S. Cl.
CPC ..... *E06B 2009/2622* (2013.01); *E06B 2009/2627* (2013.01); *E06B 2009/3265* (2013.01); *E06B 2009/785* (2013.01)

(58) Field of Classification Search
CPC ..... E06B 9/78; E06B 9/42; E06B 9/50; Y10T 403/57; Y10T 403/5733; Y10T 403/5761; Y10T 403/5766; Y10T 403/5786; Y10T 24/3904
See application file for complete search history.

(56) References Cited

U.S. PATENT DOCUMENTS

| | | | | | |
|---|---|---|---|---|---|
| 2,867,052 | A | | 1/1959 | Feibelman | |
| 4,014,136 | A | * | 3/1977 | Hemens | E05F 11/06 49/325 |
| 4,955,749 | A | | 9/1990 | Panovic | |
| 5,249,415 | A | * | 10/1993 | Frenker-Hackfort | F16G 13/06 59/78.1 |
| 5,411,445 | A | | 5/1995 | Oda | |
| 5,845,696 | A | | 12/1998 | Chou | |
| 5,987,709 | A | * | 11/1999 | Chou | A01K 27/005 24/115 F |
| 6,325,132 | B1 | * | 12/2001 | Anderson | E06B 9/36 160/173 V |
| 7,114,544 | B2 | | 10/2006 | Rice et al. | |
| 7,353,857 | B2 | | 4/2008 | Koop | |
| 8,776,859 | B2 | * | 7/2014 | Frederick | E06B 9/326 160/178.1 R |
| 8,898,871 | B2 | | 12/2014 | Nakamura et al. | |
| 2006/0243402 | A1 | * | 11/2006 | Chang | E06B 9/40 160/321 |
| 2013/0068405 | A1 | * | 3/2013 | Lava | E06B 9/78 160/321 |
| 2013/0247336 | A1 | | 9/2013 | Chou | |
| 2015/0308542 | A1 | * | 10/2015 | Fukumori | F16G 15/12 474/230 |
| 2017/0022756 | A1 | * | 1/2017 | Kao | E06B 9/78 |
| 2018/0238109 | A1 | * | 8/2018 | Kanargelidis | E06B 9/42 |
| 2019/0040678 | A1 | * | 2/2019 | Garcia Garcia | E06B 9/78 |

FOREIGN PATENT DOCUMENTS

| | | | | | |
|---|---|---|---|---|---|
| EP | 2889448 | B1 | | 10/2017 | |
| JP | 3080506 | U | | 9/2001 | |
| JP | 3945959 | B2 | | 9/2001 | |
| JP | 2001275723 | | * | 10/2001 | A44C 11/00 |
| JP | 2001275723 | A | | 10/2001 | |
| KR | 101340622 | B1 | | 12/2013 | |
| KR | 200485584 | Y1 | | 12/2013 | |
| KR | 20160018071 | A | | 2/2016 | |
| WO | 2010150799 | A1 | | 12/2010 | |
| WO | 2011136254 | A1 | | 11/2011 | |

* cited by examiner

CONNECTOR FOR A LOOPED OPERATING ELEMENT OF AN ARCHITECTURAL-STRUCTURE COVERING

CROSS-REFERENCE TO RELATED APPLICATIONS

This is a non-provisional of, and claims the benefit of the filing date of, U.S. provisional patent application No. 62/801,955, filed Feb. 6, 2019, entitled "Connector for a Looped Operating Element of an Architectural-Structure Covering," which application is incorporated by reference herein in its entirety.

FIELD OF THE DISCLOSURE

The present disclosure relates generally to architectural-structure coverings, and more particularly to a connector for use with an endless or looped operating element (e.g., a bead chain, or the like) used to move the covering between an extended and retracted positions.

BACKGROUND OF THE DISCLOSURE

Architectural-structure coverings for architectural openings and/or structures (used interchangeably herein without the intent to limit), such as windows, doors, archways, portions of a wall, and the like, have taken numerous forms for many years. Architectural-structure coverings may take many different forms. For example, roller blinds, vertical blinds, wood blinds, Roman shades, etc. One known architectural-structure covering includes a covering such as a fabric that is movable between an extended position and a retracted position. For example, the covering may be extendable or retractable (e.g., able to be lowered or raised, respectively, in a vertical direction) between an extended position and a retracted position for obscuring and exposing the underlying architectural structure. In use, some architectural-structure coverings include a rotatable member (e.g., a roller) about which the covering may be wrapped during retraction of the covering (e.g., the retracted position), and unwrapped to extend the covering (e.g., the extended position). In use, rotation of the rotatable member in a first direction may retract the covering while rotation of the rotatable member in a second, opposite direction may extend the covering. Alternatively, the covering may be movable in a horizontal direction.

The architectural-structural covering may also include an actuating or operating system operably coupled to the rotatable member and one or more actuating or operating elements, such as, for example, a bead chain, associated with the operating system to move the covering between the retracted position and the extended position. Two ends of the bead chain may be coupled together via a bead chain connector so that, in use, the bead chain may hang from, for example, the operating system in an endless loop so that one run of the depending endless loop can be pulled downwardly while the other run moves upwardly to operate the covering. Additionally, it is known to couple bead chain connectors to the bead chain along any section of the bead chain to restrict movement of the bead chain such as, for example, to set upper and/or lower limits of the covering.

However, incorporation of bead chains may raise concerns. For example, it has been found desirable with bead chains that mounting, securing, or anchoring the lower extent of the bead chain adjacent the bottom of the architectural structure provides increased child safety or protection, makes the covering easier to operate, and is aesthetically more attractive as there are no dangling elements, but rather suitably tensioned elements confined between the operating system and an anchor at the bottom of the architectural structure. Anchors at the bottom of the architectural structure are sometimes referred to as tensioners as they typically hold the bead chain in a desirably taut condition. That is, in use, the bottom extent of the bead chain is mounted to an adjacent structure (e.g., a window frame or the like) via a tensioner. In use, the tensioner may be mounted to the adjacent structure in an unlocked configuration (i.e., so that the bead chain can move therethrough). The tensioner is also mounted so that the bead chain is held in a taut condition. In this configuration, the bead chain may be moved relative to the tensioner to move the covering between the extended and retracted positions. However, in use, if the tensioner is decoupled from the adjacent structure (e.g., the tensioner is no longer mounted), the tensioner is biased to a locked configuration to prevent the bead chain from moving relative to the tensioner. In this manner, for the bead chain to function properly (e.g., to move the covering between the extended and retracted positions), the tensioner is mounted to the adjacent structure and the bead chain is maintained in a taut condition.

However, in order for a bead chain to be used in combination with a pulley, roller, or bearing such as, for example, in a tensioner, the connector needs to be able to move across the pulley, bearing, or roller. It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Disclosed herein is an architectural-structure covering. The architectural-structure covering may include a covering movable between an extended position and a retracted position, an operating system (e.g., a clutch, a gear, a motor, a drive train, a gear train, combinations thereof, etc.) for moving the covering between the extended and retracted positions, and a bead chain operatively associated with the operating system to move the covering between the extended and retracted positions.

Disclosed herein is also a connector arranged and configured to couple to the bead chain. For example, the connector may couple opposite ends of the bead chain so that the bead chain may be in the form of a continuous loop (e.g., the connector may be coupled to the opposite, free ends of the bead chain to couple the free ends together). In addition, and/or alternatively, the connector may couple to an intermediate section of the bead chain. In one example of an embodiment, the connector is arranged and configured so that, in use, the connector can move across, around, over, through, etc. (used interchangeably herein without the intent to limit) a pulley, bearing, or roller (used interchangeably herein without the intent to limit) such as, for example, the connector can pass through a tensioner coupled to the bead chain.

In one example of an embodiment, the connector is arranged and configured to self-orient with respect to, for example, a bearing to facilitate smooth operation of the bead chain as the connector moves across, for example, a bearing positioned within a tensioner. In one example of an embodiment, the connector includes a curved surface shaped to complement an outer curved surface of a bearing positioned within the tensioner. For example, the connector includes a concave surface arranged and configured to face and/or contact a curved surface, such as, for example, a convex surface, formed on a bearing so that, during use, the connector passes smoothly across the bearing. That is, in use, as the connector moves across the bearing, the connector will seek and find a path of least resistance. In this manner, the connector will self-orient so that the concave surface of the connector faces and/or contacts the convex surface of the bearing.

Figure 1:
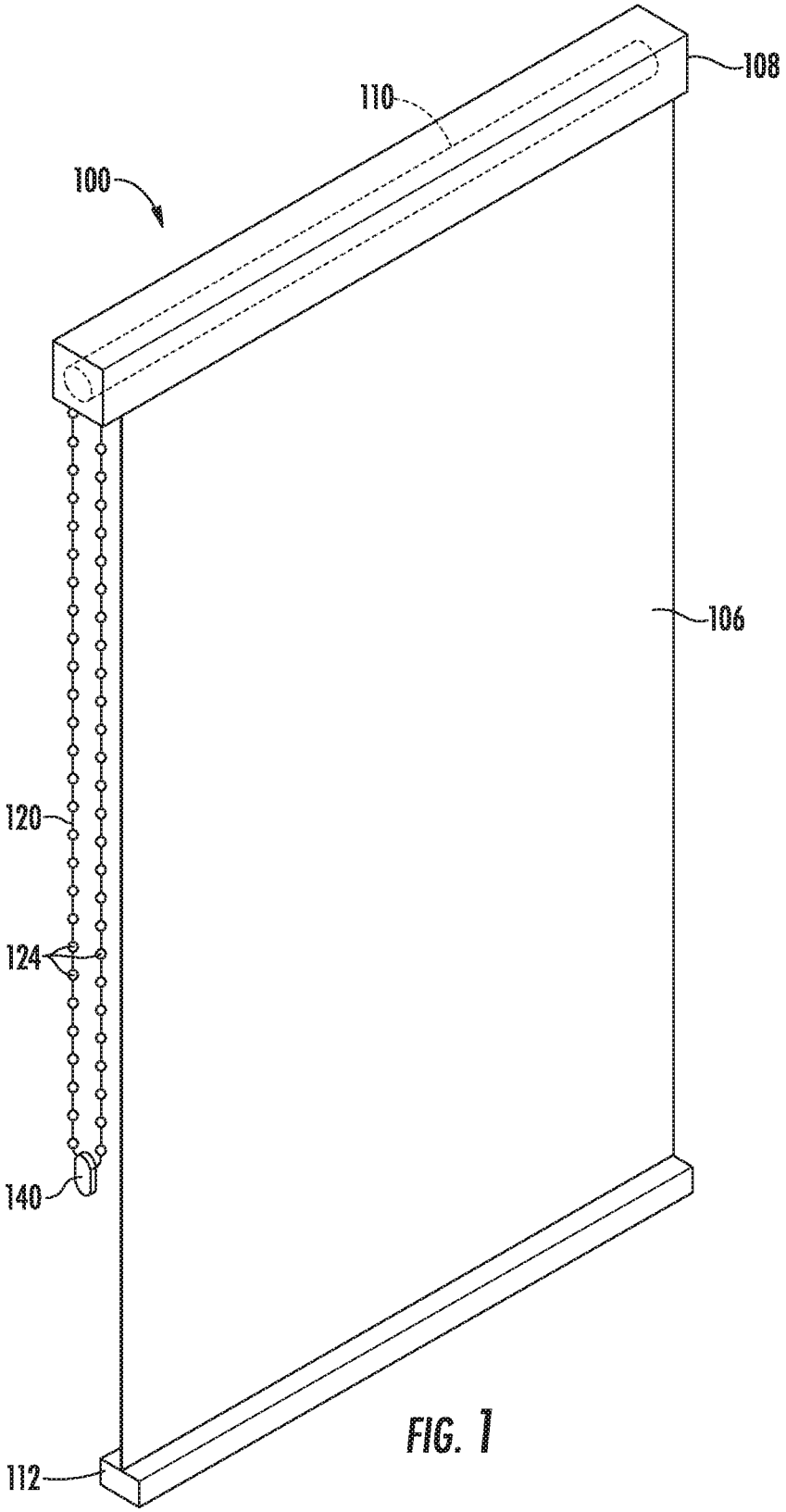
FIG. 1 is a perspective view illustrating an example of an embodiment of an architectural-structure covering including an operating element (e.g., a bead chain) and a tensioner.

The drawings are not necessarily to scale. The drawings are merely representations, not intended to portray specific parameters of the disclosure. The drawings are intended to depict exemplary embodiments of the disclosure, and therefore are not be considered as limiting in scope. In the drawings, like numbering represents like elements.

DETAILED DESCRIPTION

Numerous embodiments of a connector such as, for example, a bead chain connector, in accordance with the present disclosure will now be described more fully hereinafter with reference to the accompanying drawings, in which embodiments of the present disclosure are presented. As will be described in greater detail below, in one example of an embodiment, the connector of the present disclosure is used in connection with an operating element (e.g., a bead chain) of an architectural-structure covering. The connector of the present disclosure may, however, be embodied in many different forms and should not be construed as being limited to the embodiments set forth herein. Rather, these embodiments are provided so that this disclosure will convey certain example aspects of the connector to those skilled in the art. In the drawings, like numbers refer to like elements throughout unless otherwise noted.

It should be understood that, as described herein, an "embodiment" (such as illustrated in the accompanying figures) may refer to an illustrative representation of an environment or article or component in which a disclosed concept or feature may be provided or embodied, or to the representation of a manner in which just the concept or feature may be provided or embodied. However, such illustrated embodiments are to be understood as examples (unless otherwise stated), and other manners of embodying the described concepts or features, such as may be understood by one of ordinary skill in the art upon learning the concepts or features from the present disclosure, are within the scope of the disclosure. In addition, it will be appreciated that while the figures may show one or more embodiments of concepts or features together in a single embodiment of an environment, article, or component incorporating such concepts or features, such concepts or features are to be understood (unless otherwise specified) as independent of and separate from one another and are shown together for the sake of convenience and without intent to limit to being present or used together. For instance, features illustrated or described as part of one embodiment can be used separately, or with another embodiment to yield a still further embodiment. Thus, it is intended that the present subject matter covers such modifications and variations as come within the scope of the appended claims and their equivalents.

As will be described in greater detail herein, in use, the connector is arranged and configured to couple to an operating element, such as, for example, a bead chain. For example, the connector may be coupled to opposite ends of the bead chain. In addition, and/or alternatively, the connector may be coupled to an intermediate section of the bead chain. In one example of an embodiment, the connector is arranged and configured so that, in use, the connector moves across a bearing so that, for example, the connector can pass through a tensioner operatively coupled to the bead chain. In one example of an embodiment, as will be described in greater detail, the connector is arranged and configured to self-orient as it moves across the bearing to facilitate smooth operation of the bead chain as the bead chain moves the covering between extended and retracted positions.

In one example of an embodiment, a connector arranged and configured to couple to a bead chain of an architectural-structure covering is disclosed. In use the bead chain passes over a bearing. The connector includes a body member having an outer surface, a top portion, a bottom portion, first and second side portions, first and second end portions, a slot extending from the first end portion to the second end portion, and an interior cavity arranged and configured to receive first and second beads of the bead chain. The connector is arranged and configured to self-orient with respect to the bearing as the connector moves over the bearing to facilitate smooth operation of the bead chain as the connector moves over the bearing.

In one example of an embodiment, during use, the connector self-orients to find a path of least resistance over the bearing. For example, the body member is arranged and configured to pass over the bearing in a first orientation having a first level of resistance, and a second orientation having a second level of resistance greater than the first level of resistance. In one example of an embodiment, the body member includes a concave surface and one or more convex surfaces, wherein in the first orientation, the concave surface is in alignment with (e.g., faces) the bearing, and in the second orientation, one of the one or more convex surfaces is in alignment with (e.g., faces) the bearing. For example, one of the top portion, the bottom portion, and the first and second side portions of the body member of the connector includes a concave surface, the others of the top portion, the bottom portion, and the first and second side portions of the body member of the connector include a convex surface. In use, contact of the convex surfaces with the bearing causes the body member of the connector to self-orient so that the concave surface aligns with the bearing. In one example of an embodiment, the top portion includes the concave surface, and the bottom portion and the first and second side portions include the convex surfaces.

In one example of an embodiment, the connector includes a body member having an outer surface, a top portion, a bottom portion, first and second side portions, first and second end portions, a slot extending from the first end portion to the second end portion, and an interior cavity arranged and configured to receive first and second beads of the bead chain. In use, the top portion includes a first outer shape including a curved first surface arranged and configured to correspond with a curved surface of the bearing and the bottom portion and the first and second side portions include a second outer shape different from the first outer shape so that the connector is arranged and configured to self-orient so that the top portion of the connector moves over the bearing to facilitate smooth operation of the bead chain as the connector moves over the bearing, the first outer shape providing less resistance as compared to the second outer shape when passing over the curved surface of the bearing.

Thus arranged, the connector is arranged and configured so that a portion such as, for example, the top portion of the bearing, passes over the bearing with less resistance as compared to other portions of the bearing such as, for example, the bottom portion, and/or first and second side portions. In this manner, the top portion of the body member is arranged and configured to contact the bearing so that, in use, the connector is arranged and configured to pass over the bearing. For example, the top portion includes a concave surface having a curvature that corresponds to a curvature of the bearing. Thus arranged, the top portion is arranged and configured to pass over the bearing with minimal resistance (e.g., the first level of resistance).

In addition, and/or alternatively, the bottom portion of the body member and/or the first and second side portions of the body member each include a generally exterior spherical convex shape. Thus arranged, the bottom portion and/or the first and second side portions of the body member are arranged and configured to pass over the bearing with an increased resistance (e.g., the second level of resistance) as compared to the resistance of the top portion. In this manner, the connector will seek to self-orient so that the top portion of the connector passes over the bearing.

In addition, and/or alternatively, the interior cavity includes first and second interior cavities arranged and configured to receive first and second beads of the bead chain, respectively. An inner surface of each of the first and second interior cavities includes a curved portion arranged and configured to contact an outer surface of the first and second beads so that the outer surface of the first and second beads are arranged and configured to rotate relative to the inner surfaces. Thus arranged, the connector can self-orient with respect to the bearing.

Referring to FIG. 1, an example of an embodiment of an architectural-structure covering 100 that may be used in accordance with the present disclosure is illustrated. The architectural-structure covering 100 may include a covering 106 movable between an extended position and a retracted position, an operating system (not shown) to move the covering 106 between the extended and retracted positions, and a bead chain 120 operatively associated with the operating system to move the covering 106 between the extended and retracted positions.

Although a particular example of an architectural-structure covering 100 is shown in FIG. 1, many different types and styles of architectural-structure coverings exist and could be employed in place of the examples illustrated in FIG. 1. As such, the present disclosure should not be limited to any particular type of architectural-structure covering.

The bead chain 120 generally is operatively associated with an operating system (not shown) to move the covering 106 between the extended and retracted positions. The operating system can take any appropriate form (e.g., a clutch, a gear, a motor, a drive train, a gear train, combinations thereof, etc.). As illustrated, the bead chain 120 can be in the form of a continuous loop (e.g., a chain, or the like). As will be readily appreciated by one of ordinary skill in the art, the bead chain 120 includes a plurality of interconnected beads 124. In use, the plurality of beads 124 may be rotatably coupled relative to each other.

The architectural-structure covering 100 may also incorporate one or more pulley systems over which the bead chain may pass. For example, the architectural-structure covering 100 may also include a tensioner 140. As will be described in greater detail, the tensioner 140 may include a rotatable pulley, bearing, roller, or the like 142 (FIGS. 7-12) (used interchangeably herein without the intent to limit) for operatively associating with the bead chain 120 so that, in use, the bead chain 120 can move across the bearing 142. In use, the tensioner 140 is movable between a first configuration and a second configuration. In the first configuration, the bead chain 120 is secured relative to the tensioner 140 (e.g., prevented from moving) while in the second configuration, the bead chain 120 is freely movable relative to the tensioner 140. That is, the tensioner 140 may be arranged and configured to enable the bead chain 120 to be locked and unlocked against relative movement with respect to the tensioner 140. In the unlocked configuration (i.e., the second configuration), the bead chain 120 is permitted to move sufficiently relative to the tensioner 140 so that the covering 106 can be moved between the extended and retracted positions. In the locked configuration (i.e., the first configuration), the bead chain 120 is prevented from moving relative to the tensioner 140.

In use, the tensioner 140 may be coupled, mounted, etc. to an adjacent architectural structure in the unlocked configuration so that the bead chain 120 can be moved relative to the tensioner 140 so that the covering 106 can be moved between the extended and retracted positions. However, in use, if the tensioner 140 is decoupled from the adjacent structure (e.g., the tensioner 140 is no longer mounted), the tensioner 140 is biased to the locked configuration to prevent the bead chain 120 from moving relative to the tensioner 140. In this manner, for the bead chain 120 to function properly (e.g., to move the covering between the extended and retracted positions), the tensioner 140 is mounted to the adjacent structure and the bead chain 120 is maintained in a taut condition. For additional information on tensioners reference is hereby made to the tensioners disclosed and illustrated in U.S. Provisional Patent Application No. 62/686,851, filed on Jun. 19, 2018 entitled "Tensioner for an Architectural-Structure Covering", U.S. Pat. No. 5,845,696, filed on May 1, 1998, entitled Chain and Cord Safety Device for Adjustable Blinds, and U.S. Pat. No. 7,114,544, filed Sep. 7, 2004, entitled Cord Tensioner for Covering for Architectural Openings, although it should be understood that the bead chain connector of the present disclosure can be used with any tensioner now known or hereafter developed.

Referring to FIG. 1, for the sake of convenience and clarity, terms such as "front," "rear," "top," "bottom," "up," "down," "vertical," "horizontal", "inner," and "outer" may be used herein to describe the relative placement and orientation of various components and portions of the architectural-structure covering 100, each with respect to the geometry and orientation of the architectural-structure covering 100 as they appear in FIG. 1. Said terminology is intended to be non-limiting and is used herein merely to describe relationship between various components as illustrated in FIG. 1.

Referring to FIGS. 2-6, in one example of an embodiment, the bead chain connector 200 is arranged and configured to receive beads 124 (e.g., first and second adjacent beads) of the bead chain 120, although it is envisioned that the bead chain connector 200 could couple (e.g., receive) more or fewer beads 124. That is, as illustrated, the bead chain connector 200 includes an interior cavity 230 for receiving beads 124 of the chain 120. For example, as illustrated, the interior cavity 230 may include first and second interior cavities 230A, 230B for receiving first and second beads, respectively, while enabling the bead chain 120 to pass therethrough. That is, as illustrated, the bead chain connector 200 may include a body member 210 having an outer surface 212, a top portion 214, a bottom portion 216, first and second side portions 218, 220, and first and second end portions 222, 224. In addition, as illustrated, the body member 210 includes an elongated slot 228 extending from the first end portion 222 to the second end portion 224, the elongated slot 228 being in communication with the top portion 214. In this manner, the body member 210 can be seen to include first and second arms 232, 234 and the body member 210 can be seen as having a generally U-shaped, cross-sectional configuration.

As such, when assembled, the body member 210 may be coupled to the bead chain 120 of an architectural-structure covering 100 with first and second beads of the bead chain 120 received in the first and second interior cavities 230A, 230B formed in the body member 210, respectively. The bead chain 120 passes through the elongated slot 228 formed in the body member 210.

In use, the bead chain connector 200 may be coupled to the bead chain 120 by any mechanism now known or hereafter developed including, for example, a snap-fit connection, adhesives, or any other mechanical engagement to hold the connector 200 on the bead chain 120. In one example of an embodiment, as illustrated, the first and second arms 232, 234 formed by the elongated slot 228 in the body member 210 are arranged and configured to flex with respect to each other so that the first and second beads of the bead chain 120 are retained (e.g., received, coupled, etc.) within the first and second interior cavities 230A, 230B formed in the connector 200 via a snap-fit connection (e.g., the first and second arms 232, 234 are arranged and configured to flex with respect to each other so that the first and second arms 232, 234 deflect when the first and second beads are inserted into the first and second interior cavities 230A, 230B).

Figure 2:
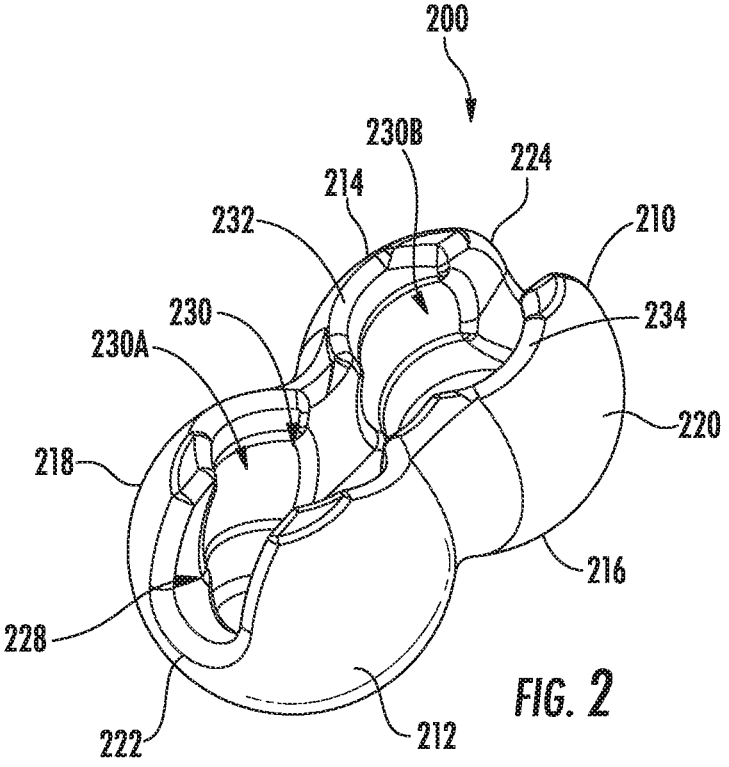
FIG. 2 is a perspective view illustrating an example of an embodiment of a connector that may be used in connection with the bead chain of the architectural-structure covering shown in FIG. 1.
Figure 3:
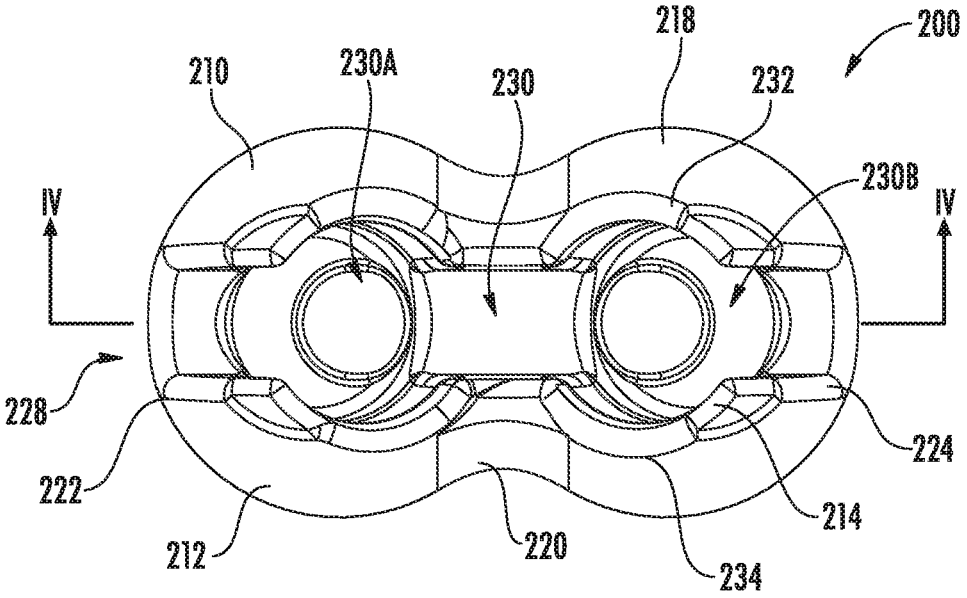
FIG. 3 is a top view of the connector shown in FIG. 2.
Figure 5:
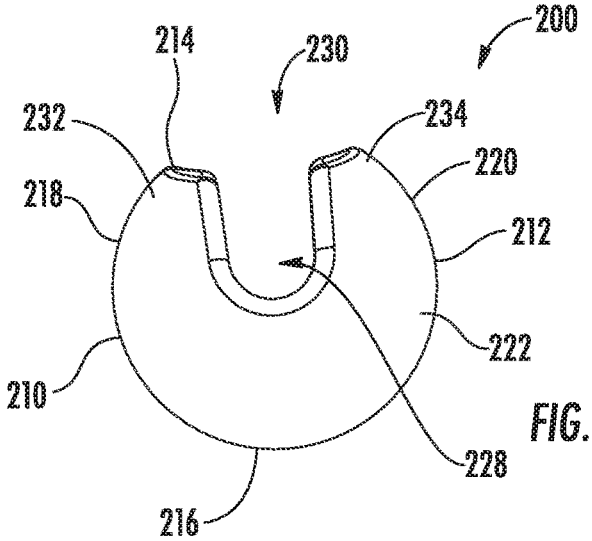
FIG. 5 is an end view of the connector shown in FIG. 2.
Figure 6:
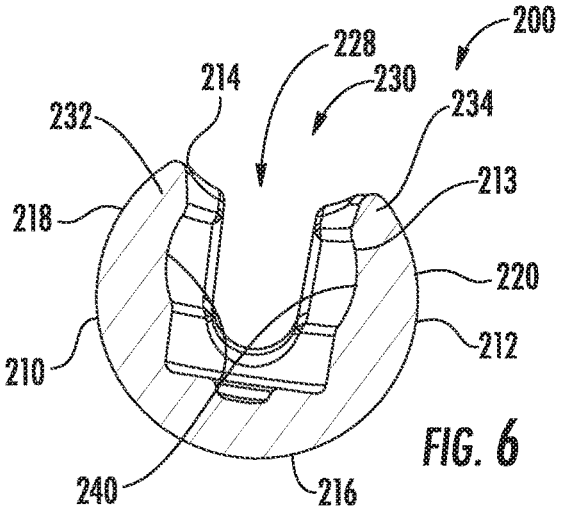
FIG. 6 is a cross-section view of the connector shown in FIG. 2, the cross-sectional view taken along line VI-VI in FIG. 4.

As illustrated in FIGS. 2, 5, and 6, the outer surface 212 of the body member 210 may have a generally exterior spherical, convex shape except for the top portion 214 which, as will be described in greater detail, includes a generally concave shape. In this manner, the outer surface 212 of the bead chain connector 200 may include an outer shape similar to the shape of the beads 124 so that the bead chain connector 200 is less visible to an end user. In addition, thus arranged, the outer surface 212 of the body member 210 may have a generally convex surface so that, during use, to the extent that the outer surface 212 (e.g., the spherically shaped, convex outer surface) of the bottom portion 216 or the side portions 218, 220 of the connector 200 come into contact with the bearing 142, the connector 200 will seek to re-orient itself so that the top portion 214 of the connector 200 faces and/or contacts the outer surface 144 (FIGS. 7-12) formed on the bearing 142. That is, in one embodiment, since the exterior spherical, convex shape of the bottom portion 216 and the side portions 218, 220 of the connector 200 do not correspond with the contour of the convex outer surface 144 formed on the bearing, the connector 200 will re-orient so that the top portion 214 (e.g., the concave top portion) moves across the convex outer surface 144 (e.g., the top portion 214 of the connector 200 is arranged and configured to correspond to the convex outer surface 144 of the bearing 142 to allow smoother operation). The outer surface 212 (e.g., the spherical shaped convex outer surface) of the bottom portion 216 or the side portions 218, 220 of the connector 200 create an increased level of instability (as compared to the top portion 214) when facing and/or contacting the bearing 142 such that the connector 200, in seeking to find the path of least resistance, will re-orient the top portion 214 (e.g., the concave top portion) of the connector 200 with the convex outer surface 144 formed on the bearing 142 to reach a more stable position. That is, in use, the amount of force required for the connector 200 to move across the convex outer surface 144 formed on the bearing 142 is greater when the bottom portion 216 (e.g., the convex bottom portion) or the side portions 218, 220 (e.g., the convex side portions) of the connector 200 face and/or contact the convex outer surface 144 formed on the bearing 142 as compared to when the top portion 214 (e.g., the concave top portion) of the connector 200 faces and/or contacts the convex outer surface 144 of the bearing 142 (e.g., the convex bottom portion 216 and the convex side portions 218, 220 of the connector 200 are unstable against the convex outer surface 144 of the bearing 142, causing the connector 200 to rotate and re-orient until at least a portion of the top portion 214 (e.g., the concave top portion) of the connector 200 faces or contacts the convex outer surface 144 of the bearing 142. Thus arranged, the connector 200 has a low-resistance path about the bearing 142).

In addition, to the extent that the connector 200 fails to self-orient, as will be described in detail below, during, for example, a first pass across the bearing 142, the outer surface 212 (e.g., the spherical shaped convex outer surface) of the connector 200 contacts the bearing 142 so that the connector 200 can move across the bearing 142 so that the connector 200 can pass through, for example, the tensioner 140 with either the bottom portion 216 or the side portions 218, 220 of the connector 200 facing and/or contacting the bearing 142 (FIGS. 7-12) (e.g., albeit with operation of the connector 200 moving across the bearing 142 in a more disjointed manner).

In addition, as illustrated in FIG. 6, an inner surface 213 of the first and second interior cavities 230A, 230B formed in the body member 210 may include a curved portion 240 (e.g., a concave portion) for receiving the spherical, convex outer surfaces of the beads 124. In one example of an embodiment, the curved portion 240 of the first and second interior cavities 230A, 230B include a curvature that corresponds (e.g., substantially matches) with the curved outer surfaces of the beads 124. In this manner, the body member 210 is better able to retain the beads 124. In addition, the corresponding curved surfaces enable the body member 210 to rotate or swivel relative to the beads 124 so that, as will be described in greater detail below, the connector 200 is arranged and configured to self-orient to present a conforming surface to the bearing 142 as it moves across the bearing 142.

Figure 4:
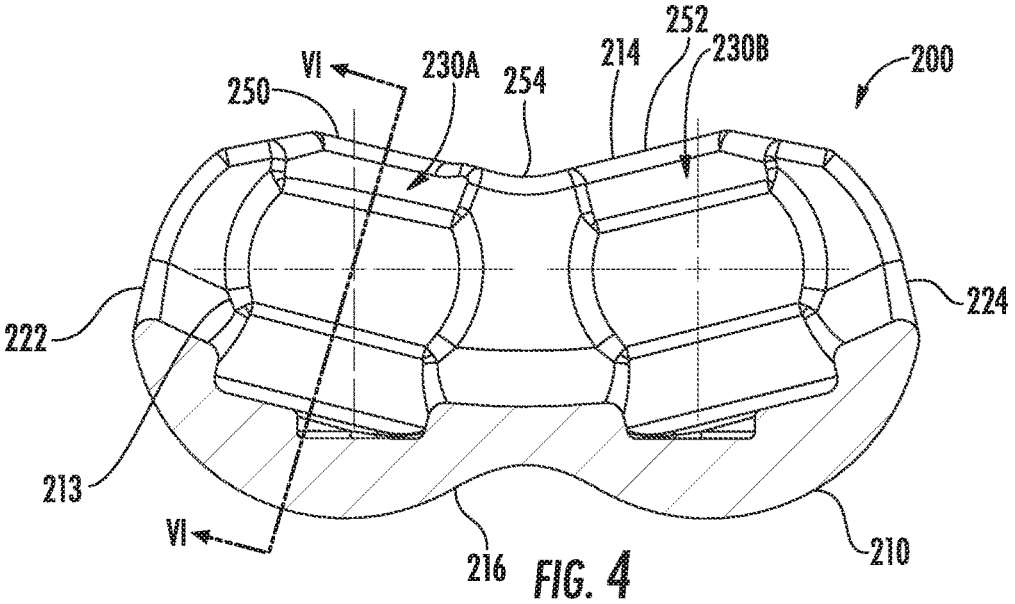
FIG. 4 is a cross-sectional view of the connector shown in FIG. 2, the cross-sectional view taken along line IV-IV in FIG. 3.

Referring to FIG. 4, the top portion 214 (e.g., the concave top portion) of the connector 200 is arranged and configured to face and/or contact the bearing 142 (FIGS. 7-12) in, for example, the tensioner 140 so that, in use, the connector 200 passes more smoothly across the bearing 142 and, for example, through the tensioner 140. For example, as illustrated, the top portion 214 may include a curved, concave surface. In one example of an embodiment, the concave surface of the top portion 214 may include a curvature that corresponds (e.g., substantially matches) the curvature of the bearing 142. In one example of an embodiment, as illustrated, the top portion 214 (e.g., the concave top portion) may include first and second flat or straight surfaces (e.g., non-curved surfaces) 250, 252 positioned on either side of a curved, concave portion 254. Alternatively, the top portion 214 including the first and second surfaces 250, 252 may be formed by a continuously curved, concave surface. In either configuration, as will be described in greater detail, the top portion 214 (e.g., the concave top portion) of the connector 200 is arranged and configured to face and/or contact the convex outer surface 144 (FIGS. 7-12) formed on the bearing 142. In addition, it will be appreciated that other configurations are within the scope of the present disclosure.

In use, the top portion 214 (e.g., the concave top portion) of the connector 200 is arranged and configured so that the amount of force required for the connector 200 to move across the convex outer surface 144 formed on the bearing 142 is less when the top portion 214 (e.g., the concave top portion) of the connector 200 faces and/or contacts the convex outer surface 144 formed on the bearing 142 as compared to when the bottom portion 216 (e.g., the convex bottom portion) or the side portions 218, 220 (e.g., the convex side portions) of the connector 200 face and/or contact the convex outer surface 144 of the bearing 142. In this manner, the connector 200, in seeking to find a path of least resistance across the bearing 142, will self-orient so that the top portion 214 (e.g., the concave top portion) of the connector 200 faces the convex outer surface 144 of the bearing 142 thereby enabling the connector 200 to pass smoothly across the convex outer surface 144 of the bearing 142.

In one example of an embodiment, as illustrated in FIG. 4, the first and second interior cavities 230A, 230B are arranged and configured so that their centers are arranged on a straight line that is parallel to a surface of the bearing 142 as the connector 200 moves across the bearing 142.

Referring to FIGS. 7-12, in use, the connector 200 is arranged and configured to orient with the bearing 142 in, for example, the tensioner 140 so that the top portion 214 (e.g., the concave top portion) of the connector 200 faces the bearing 142 to facilitate smooth passage of the connector 200 across the bearing 142. For example, in one example of an embodiment, the geometry of the first and second interior cavities 230A, 230B enable the first and second beads to rotate relative to each other. In this manner, the beads 124 of the bead chain 120 can rotate, swivel, etc. within the interior cavities 230A, 230B of the connector 200 to enable the connector 200 to rotate relative to the bearing 142. Thus, during use, tension force applied by a user to move the bead chain 120 in order to move the covering 106 between the extended and retracted positions (e.g., pulling on the bead chain) facilitates the connector 200 orientating (e.g., rotating) so that the top portion 214 (e.g., the concave top portion) of the connector 200 faces the convex outer surface 144 of the bearing 142. In this manner, if the top portion 214 (e.g., the concave top portion) of the connector 200 is orientated with the convex outer surface 144 of the bearing 142, the connector 200 passes across the bearing 142 in a smooth manner. That is, in use, as the connector 200 moves across the bearing 142, force from the bead chain 120 is transferred to the connector 200, which given its configuration (e.g., curved surfaces between the inner surface of the interior cavities 230A, 230B of the connector 200 and the outer surface of the beads 124) will seek to find a path of least resistance thus causing the connector 200 to self-orient so that the top portion 214 (e.g., the concave top portion) of the connector 200 will rotate relative to the bead chain 120 so that the top portion 214 (e.g., the concave top portion) of the connector 200 faces the convex outer surface 144 of the bearing 142 enabling the connector 200 to pass smoothly across the convex outer surface 144 of the bearing 142.

Figure 7:
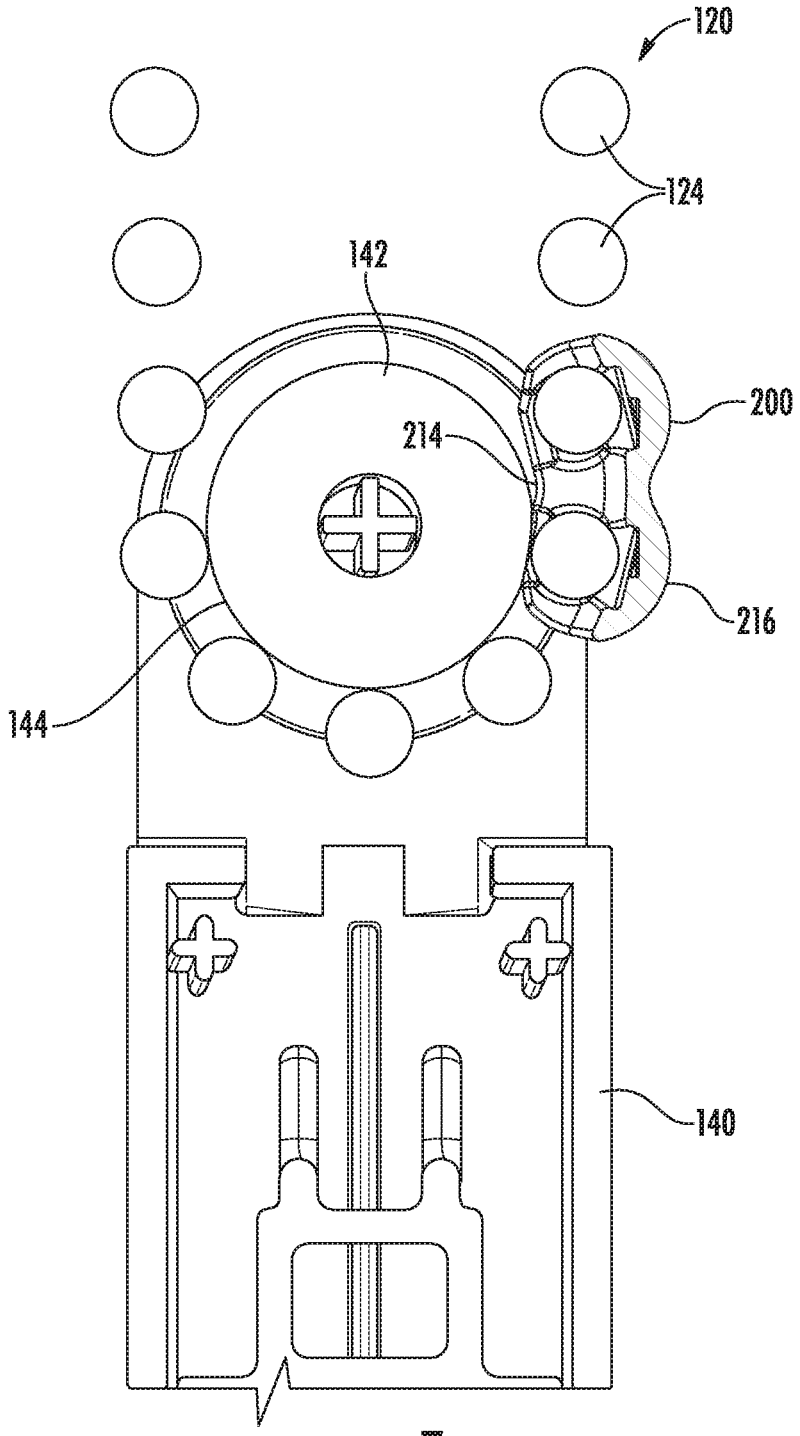
FIGS. 7-12 illustrate various cross-sectional views of the connector shown in FIG. 2 moving across a bearing in, for example, a tensioner.
Figure 8:
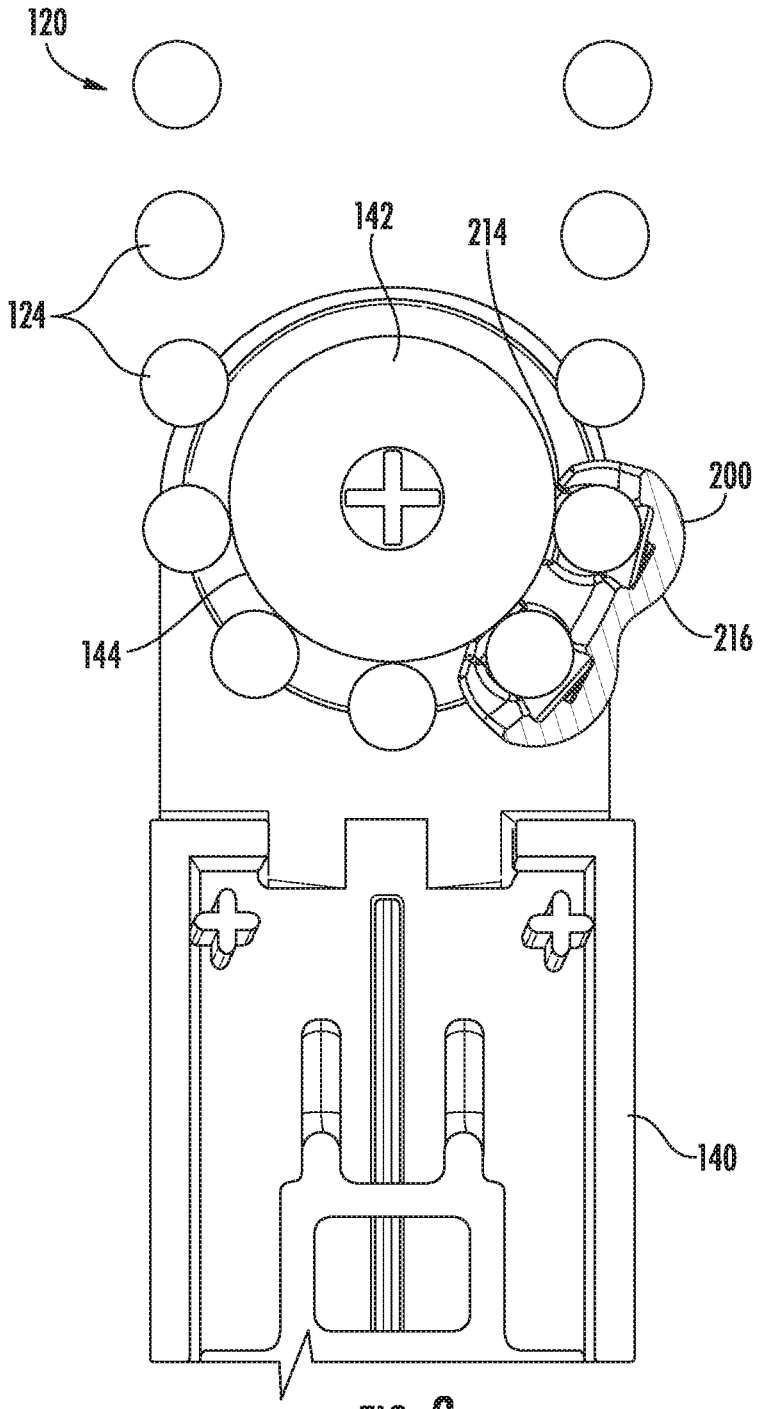
Figure 9:
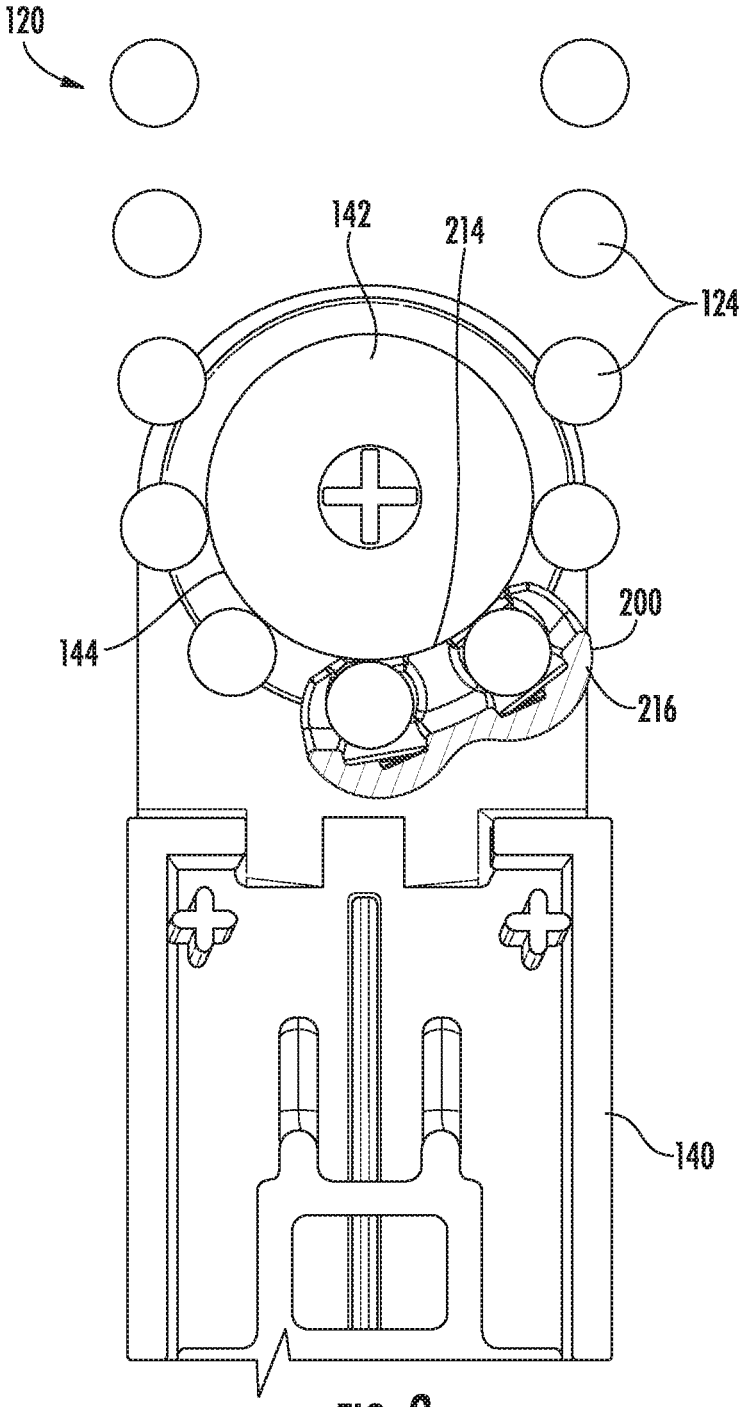
Figure 10:
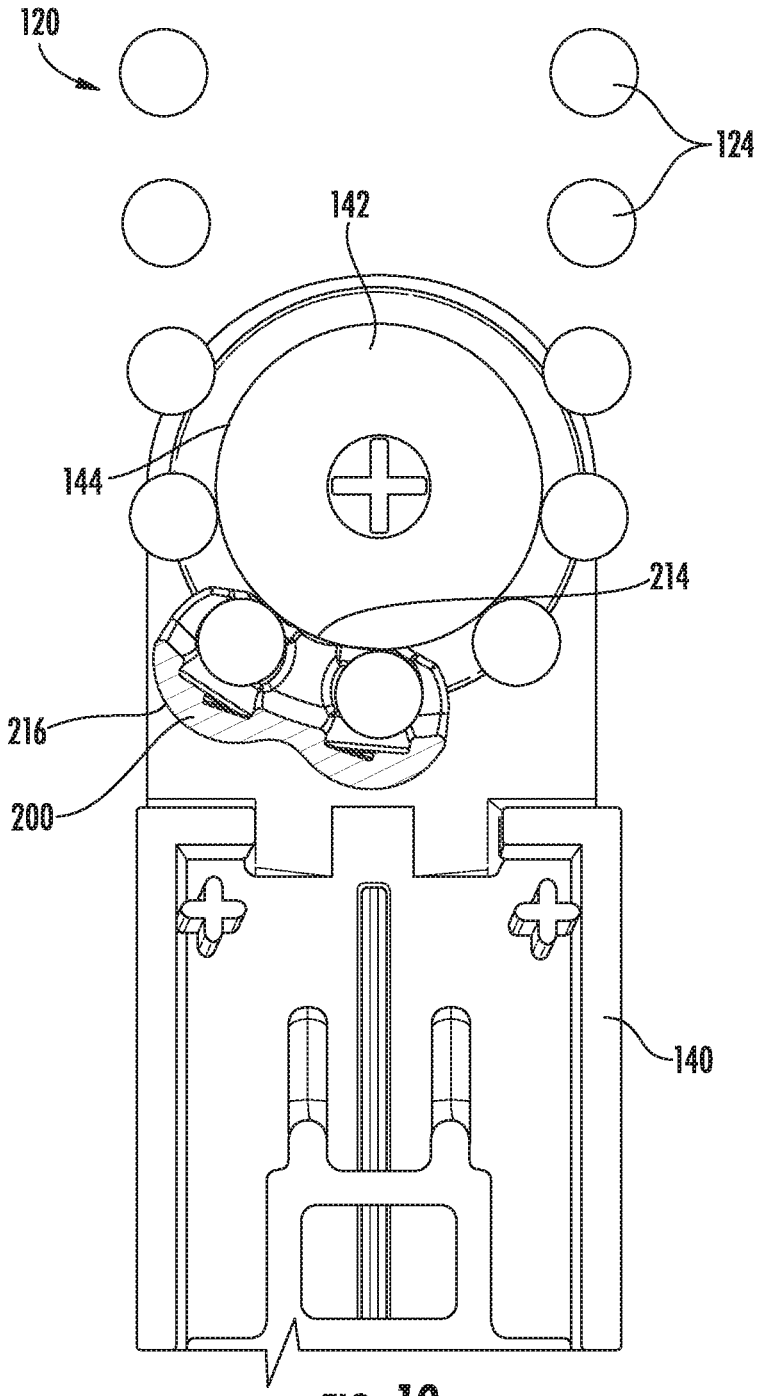
Figure 11:
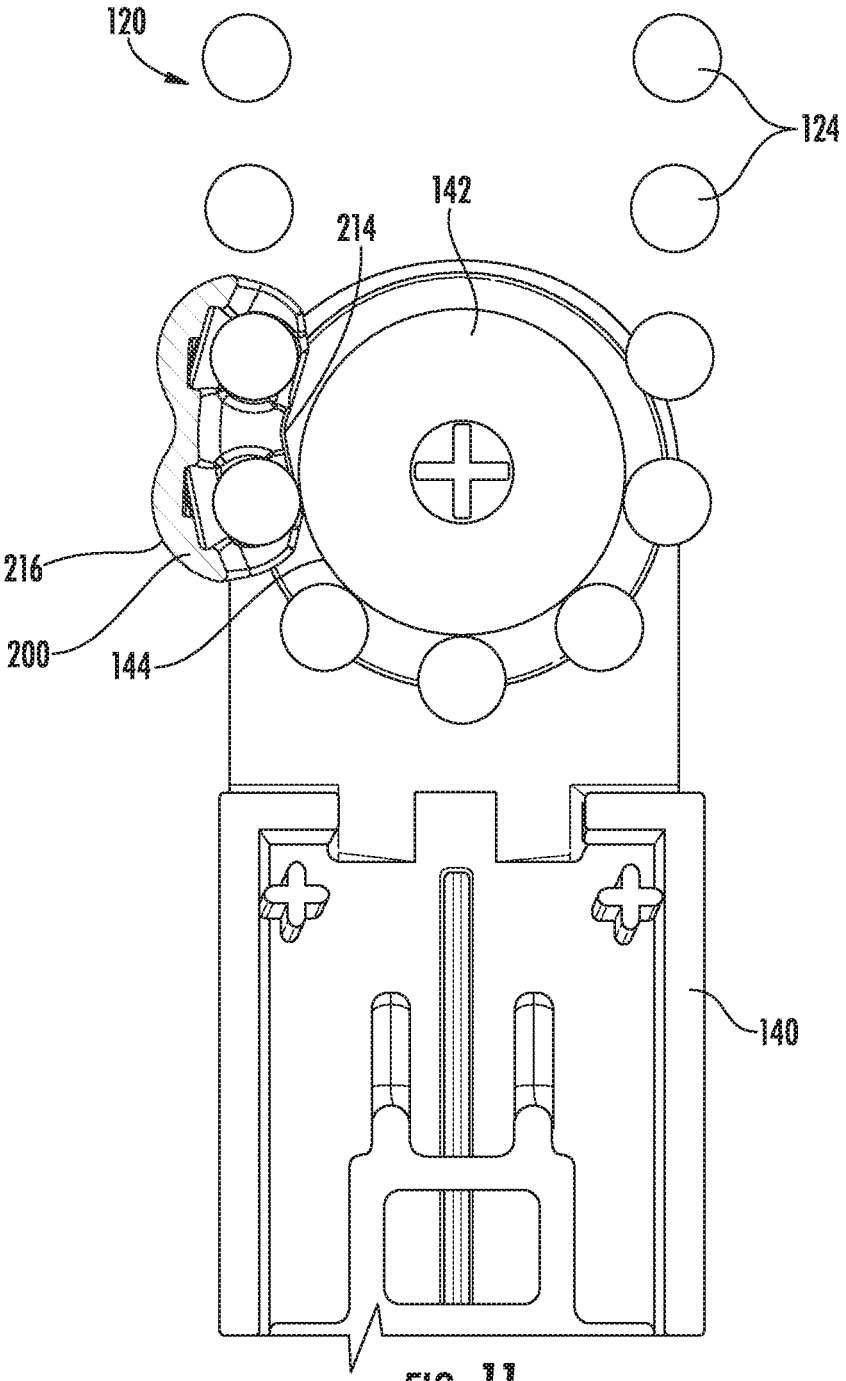
Figure 12:
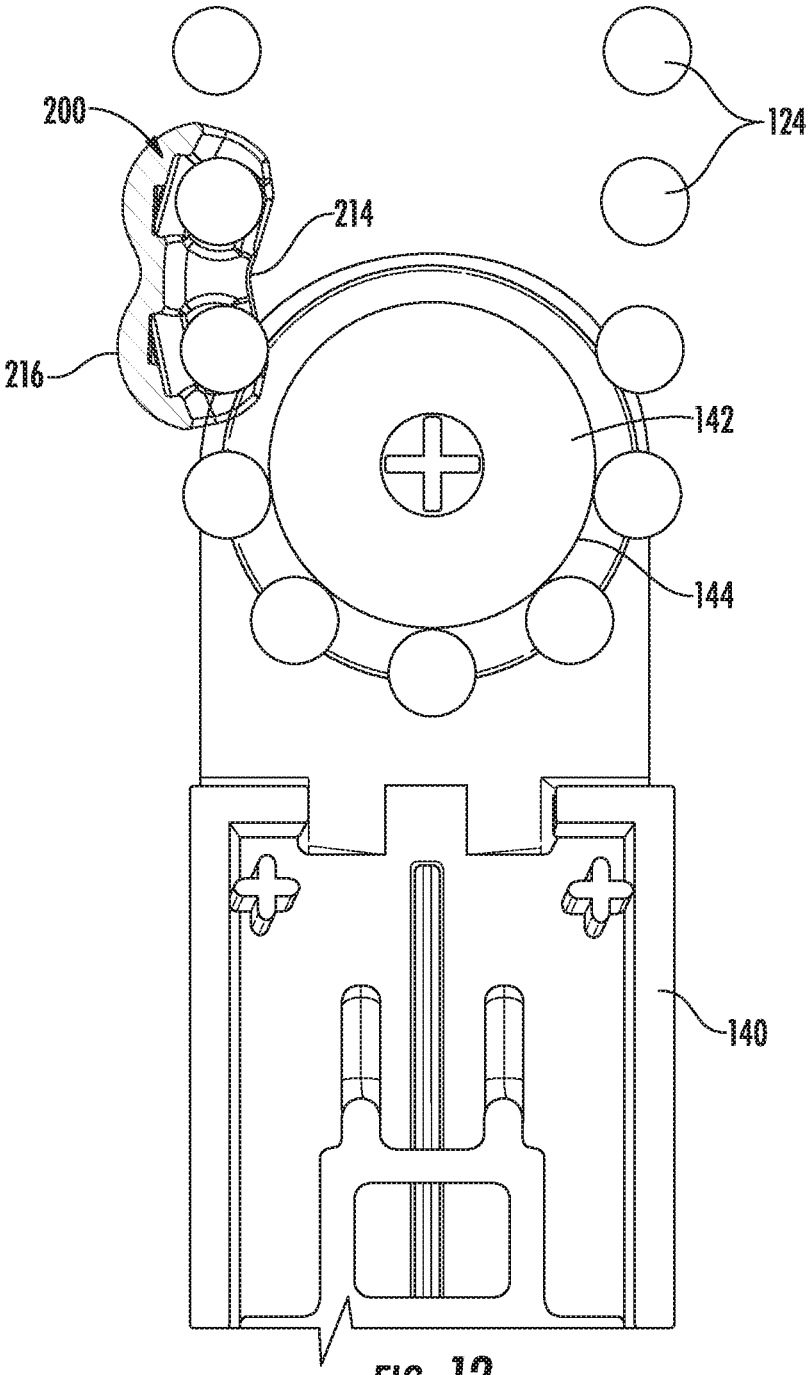

For example, as illustrated in FIG. 7, the connector 200 enters an opening formed in, for example, the tensioner 140. As previously described, the connector 200 is arranged and configured to self-orient, via, for example, the tension applied by the user moving the bead chain 120 to move the covering 106 between the extended and retracted positions, so that the top portion 214 (e.g., the concave top portion) of the connector 200 faces the convex outer surface 144 of the bearing 142. Referring to FIGS. 8-10, as the bead chain 120 continues to move through the tensioner 140 (e.g., across the convex outer surface 144 of the bearing 142), once the connector 200 has properly orientated itself, the top portion 214 (e.g., the concave top portion) of the connector 200 remains orientated with the convex outer surface 144 of the bearing 142 thereby facilitating smooth operation of the bead chain 120 as the connector 200 moves across the convex outer surface 144 of the bearing 142. In one example of an embodiment, the concave surface of the top portion 214 of the connector 200 may be substantially similar to the curvature of the convex outer surface 144 of the bearing 142. Referring to FIGS. 11-12, as the bead chain 120 makes its way out of the opening formed in the tensioner 140, the top portion 214 (e.g., the concave top portion) of the connector 200 remains orientated with the convex outer surface 144 of the bearing 142.

The connector 200 may be manufactured from any suitable material now known or hereafter developed including, for example, a plastic, an elastomer, or the like. In one example of an embodiment, the connector 200 is manufactured from an amorphous, durable material such as, for example, a polycarbonate or some variation thereof. In this manner, the connector 200 is less visible to the end user while being sufficiently durable to withstand continuous impact with the tensioner and/or operating system, and to prevent beads 124 from falling out of the cavities of the connector 200.

As illustrated in FIG. 1, in one example of an embodiment, the covering 106 may be a flexible material having an upper edge coupled to a rotatable member 110 and a lower edge. A bottom rail 112 may be coupled to the lower edge of the covering 106. However, it should be understood that the covering 106 may be any suitable covering now known or hereafter developed including, for example, a stacked or tiered covering such as, for example, a Roman shade, a horizontal cellular shade, a horizontal Venetian shade, or the like.

As illustrated, the architectural-structure covering 100 may also include a headrail 108, which may include a housing having opposed end caps (not shown) to form an open-bottom enclosure. The headrail 108 may also include attachments or brackets (not shown) for coupling the headrail 108 to a structure above, or at the top of, an architectural opening, such as a wall, via mechanical fasteners such as screws, bolts, or the like. In use, the headrail 108 may house the rotatable member 110. Once again, many different types and styles of architectural-structure coverings exist and could be employed in place of the example illustrated in FIG. 1.

While the present disclosure refers to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The foregoing description has broad application. It should be appreciated that the concepts disclosed herein may apply to many types of coverings, in addition to the roller-type coverings described and depicted herein. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. All rotational references describe relative movement between the various elements. Identification references (e.g., primary, secondary, first, second, third, fourth, etc.) are not intended to connote importance or priority but are used to distinguish one feature from another. The drawings are for purposes of illustration only and the dimensions, positions, order and relative to sizes reflected in the drawings attached hereto may vary.

What is claimed:

1. A connector bead chain system for use with an architectural-structure covering, comprising:

a bead chain including a plurality of beads including first and second beads;

a bearing including a smooth, curved surface; and a connector including:

a body member having an outer surface, a top portion, a bottom portion, first and second side portions, first and second end portions, a longitudinal axis extending from the first end portion to the second end portion, a transverse axis extending perpendicular to the longitudinal axis, a slot formed in the top portion, the slot extending from the first end portion to the second end portion and parallel to the longitudinal axis, and an interior cavity in communication with the slot so that the first and second beads can pass through the slot formed in the top portion and be received within the interior cavity; and wherein the top portion includes a first outer shape including a curved first surface arranged and configured to contact the smooth curved surface of the bearing and the bottom portion and the first and second side portions include a second outer shape different from the first outer shape so that the connector always rotationally self-orients about the longitudinal axis such that the top portion of the connector is in direct contact with the smooth, curved surface of the bearing to facilitate operation of the bead chain as the connector moves over the bearing, the first outer shape providing less resistance as compared to the second outer shape when passing over the curved surface of the bearing.

2. The connector bead chain system of claim 1, wherein the architectural-structure covering further comprises a cord tensioner coupled to the bead chain, the cord tensioner including the bearing.

3. The connector bead chain system of claim 1, wherein the curved first surface of the top portion includes a concave surface.

4. The connector bead chain system of claim 3, wherein the concave surface includes a curvature that matches a curvature of the smooth, curved surface of the bearing.

5. The connector bead chain system of claim 1, wherein the curved first surface of the top portion includes first and second flat or straight surfaces positioned on either side of a concave portion.

6. The connector bead chain system of claim 1, wherein the interior cavity includes first and second interior cavities arranged and configured to receive the first and second beads of the bead chain, respectively.

7. The connector bead chain system of claim 6, wherein an inner surface of each of the first and second interior cavities includes a curved portion arranged and configured to contact an outer surface of the first and second beads, respectively, so that the outer surface of the first and second beads are arranged and configured to rotate relative to the inner surface of the first and second interior cavities, respectively.

8. The connector bead chain system of claim 6, wherein the body member includes first and second arms defining a U-shaped cross-sectional configuration.

9. The connector bead chain system of claim 8, wherein the first and second arms are arranged and configured to flex with respect to each other so that the first and second arms deflect when the first and second beads are inserted into the first and second interior cavities.

10. The connector bead chain system of claim 1, wherein the second outer shape of the bottom portion of the body member includes an exterior spherical convex shape.

11. The connector bead chain system of claim 1, wherein the second outer shape of the first and second side portions of the body member each include an exterior spherical convex shape.

12. The connector bead chain system of claim 1, wherein the curved first surface of the top portion includes a concave surface and the second outer shape of the bottom portion and the first and second side portions includes one or more convex surfaces.

13. The connector bead chain system of claim 12, wherein contact of the one or more convex surfaces with the curved surface of the bearing causes the body member of the connector to rotationally self-orient about the longitudinal axis so that the concave surface of the top portion of the body member aligns with the smooth, curved surface of the bearing.

14. The connector bead chain system of claim 1, wherein the architectural-structure covering includes a covering movable between an extended position and a retracted position, the bead chain operatively associated with the covering to move the covering between the extended and retracted positions.

* * * * *